United States Patent [19]

Finke et al.

[11] Patent Number: 4,773,529

[45] Date of Patent: Sep. 27, 1988

[54] TWO-COMPONENT PACKAGE

[76] Inventors: Robert G. Finke, Zur Fielbecke 21, 5950 Finnentrop; Clemens Schumacher, Grimmestrasse 12, 5768 Sundern 1, both of Fed. Rep. of Germany

[21] Appl. No.: 24,692

[22] Filed: Mar. 11, 1987

[30] Foreign Application Priority Data

Mar. 13, 1986 [DE] Fed. Rep. of Germany ... 8606940[U]

[51] Int. Cl.[4] ..... B65D 25/08

[52] U.S. Cl. ..... 206/222; 215/DIG. 8

[58] Field of Search ..... 206/219, 222; 215/DIG. 8

[56] References Cited

U.S. PATENT DOCUMENTS 3,613,955 10/1971 Wetheree, Jr. ..... 215/DIG. 8
4,386,696 6/1983 Goncalves ..... 215/DIG. 8
4,591,050 5/1986 Finke et al. ..... 215/DIG. 8
4,615,437 10/1986 Finke et al. ..... 215/DIG. 8
4,667,818 5/1987 Evans ..... 206/219

*Primary Examiner*—Joseph Man-Fu Moy
*Attorney, Agent, or Firm*—Collard, Roe & Galgano

[57] ABSTRACT

Two-component package, with a cup arranged in the neck of the packaging container for receiving the one component, and a sealing cap screwed to a thread of the neck and having a collar projecting into the cup, the face edge of such collar forming a butt edge for separating the cup within the zone of a rated breaking point by a screw motion of the sealing cap, characterized in that the neck (1) is designed multi-layered in a way such that an adapter ring (13) is present on the outer side of the annular wall (W) of the neck (1), such wall starting from the wall (3') of the packaging container and being stiffened by the cup (2), such adapter ring being secured against rotation on such annular wall, the outer jacket surface of such adapter ring supporting the thread (14) for the sealing cap (4) and its inner surface forcing the annular wall (W) against the jacket surface of the cup.

10 Claims, 4 Drawing Sheets

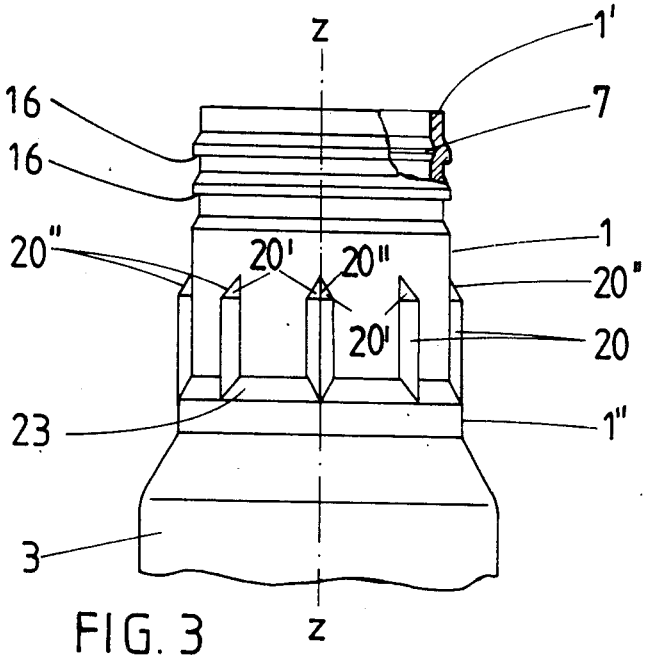
FIG. 3
FIG. 4
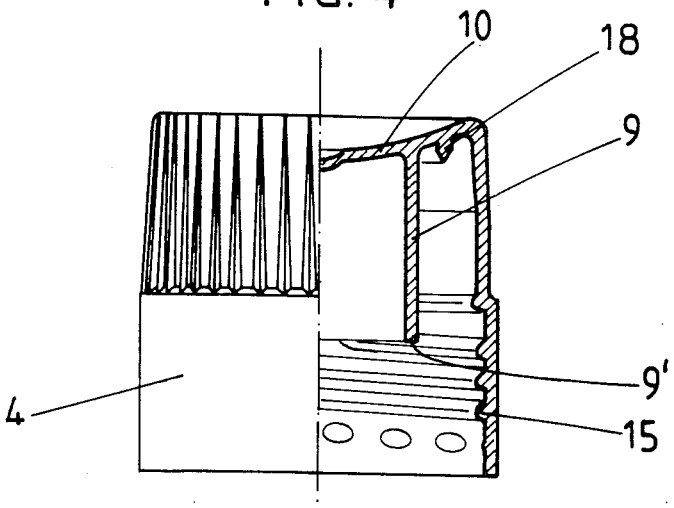

TWO-COMPONENT PACKAGE

DESCRIPTION

The invention relates to a two-component package of the type specified in the preamble of claim 1.

A two-component package of this type is known from German Pat. DE-PS No. 33 27 615. Packaging containers are manufactured with special economy by the blowing process. As a rule, relatively elastic plastics are used, which offers the advantage of superior adaptation, among others, for example to interior pressures that vary depending on the temperature. On the other hand, the low material thickness deemed desirable with such containers, i.e., the low wall thickness may cause a certain yielding tendency in the zone of the neck, which might adversely affect the tightness. Furthermore, the quality of the material used may be of importance.

The problem of the invention is to design a two-component package of the type specified above in a simple way in terms of manufacturing technology and with stability during usage in a manner such that the greatest possible independence from the neck zone is assured without abandoning the basic principle described in the above-mentioned German Patent.

This problem is resolved by the invention disclosed in claim 1.

The subclaims contain beneficial additional features of the two-component package according to the invention.

By virtue of the embodiment of the invention, a two-component package particularly having an increased intrinsic value has been created: Even packages with yet lower wall thicknesses can be produced without abandoning the separation of the cup in the course of the unscrewing motion of the sealing cap, which is favorable in terms of forces. Yet surprisingly high stability is obtained in the zone of the neck owing to the multi-layered structure in that zone. The annular wall of the neck is surrounded by an adapter ring, which stabilizes or supports the neck in the manner of a collar. Plastics can be used as material as well. Such material can be optimally selected in view of the thread engagement. The cup itself stiffens the annular wall of the neck on the inner side, and the inner surface of the adapter ring applies pressure to the annular wall on the outer side. In this way, the annular wall of the neck is practically form-locked between the cup and the adapter. Even higher stresses will not impair the sealing function or function of the thread joint in this zone. Furthermore, when the sealing cap is rotated, the adapter ring is not carried along because it is associated in a way which secures it against rotation. Advantageously, a form-locked bead/groove joint is realized between the jacket surface of the cup and the annular wall. In this way, the cup is fixed with axial stability also against the neck and, at the same time, secured in a sealing manner, whereby this joint is supported also by the adapter that is gripping around this assembly. On the outer side, the annular wall of the neck has shoulders which are clipped over by counter shoulders of the adapter ring. In terms of assembly or association technology, the best procedure is as follows: The adapter ring is first slipped over the neck, which is accomplished with exploitation of a radially centric yielding motion of the relatively thin annular wall of the neck. The subsequent insertion of the cup in the opening of the neck effects an outwardly directed clamping force, which produces an even more intimate engagement between the beads and grooves. Advantageously, the cup has an outwardly projecting, molded edge gripping over the top face edge of the neck and the adapter ring. In addition to the high sealing degree so achieved in the layer joints of the multi-layered neck, this has an advantage in that it permits an embodiment in which the sealing cap has an annular bridge starting from its pot bottom surface, such bridge being seated in a tight manner on the collar of the cup when the sealing cap is in its final screwed-on position. In this way, the collar of the cup, which has a matching width, additionally secures the adapter ring against being pulled off. The annular bridge may have the form of a lip so as to increase the sealing fit. Furthermore, it was found that it is advantageous if the jacket surface of the collar of the sealing cap has a annular sealing bead contacting the corresponding inner surface of the cup. In this way, the first component is optimally sealed. The collar forms the inner support and the jacket wall of the sealing cap forms the outer support of the layers formed by the cup, neck and adapter ring, which are practically framed in a U-shaped annular space. The adapter ring is secured against rotation by axially aligned fillets on the annular wall and inner surface of the adapter, which fillets engage one another like a claw coupling. The fillets extend in a joint zone formed by wall displacement. In this connection, it was found that it is advantageous if the face ends of the fillets disposed in the coupling direction have roof-like centering bevels whose coping, in the final plugged position, are disposed in front of equally aligned bevelled steps of the joint zone. In this way, a safe plug-on limitation is obtained for the adapter ring with a weak or minor extension component, which is outwardly directed as well, and which further promotes the thread engagement between the sealing cap and the adapter. Finally, with a view to obtaining a constructionally simple indication of the condition of the contents, i.e., whether mixing has occurred or whether the two-component package is still in the original state, it is favorable that in the basic sales position, the end of the adapter ring on the container side freely projects by a measure as compared to the corresponding edge of the sealing cap, such measure conforming to the remaining lift of the sealing cap in the final screwed-on position. Consequently, the adapter ring has an additional function, for which purpose it may have a different color. On the other hand, it is sufficient if the segment of the adapter ring forming the sight ring, such segment being exposed in the original condition of the package, has a different color for more conspicuous marking. Also, application of a signal color is conceivable, so that the indication is even more highlighted, optically speaking.

The subject matter of the invention is explained in greater detail in the following by reference to an embodiment shown in the drawing, in which:

FIG. 3 shows the partly broken neck of the packaging container;

FIG. 4 is a partly sectional view of the sealing cap;

Figure 1:
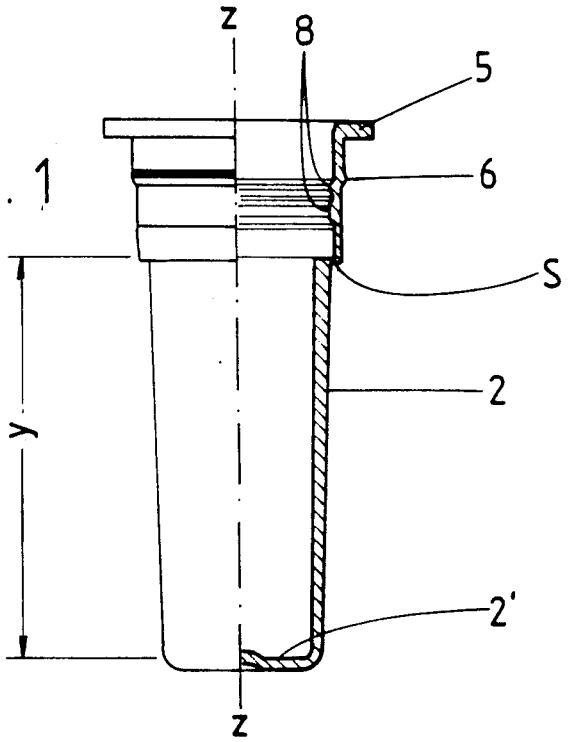
FIG. 1 shows an individual view of the cup of the two-component package, in a partly sectional illustration.

The two-component package shown in the drawing is designed to receive the one component I in the cup 2, which is inserted in its neck 1, and another component II in the packaging container 3, which has a larger volume.

The cup 2 is separated for mixing the two components I and II. A sealing cap 4, which can be associated with the neck 1 via the screw connection, serves as the separating tool.

In its top section, which substantially has a cylindrical shape, the cup 2 made of plastic material forms an outwardly directed edge 5. The latter grips over the corresponding face edge 1' of the neck 1, defining in this way the depth to which the cup 2 is suspended. The latter is additionally secured against dropping out. For this purpose, a bead 6 is molded on the jacket surface of the cup slightly beneath the edge 5, which bead is in form-locked engagement with a matching groove 7 on the inner surface of the neck 1. The cup 2 can be easily inserted as the bead 6, which acts as a seal or gasket, snaps into position only at the last moment without preventing the expelled air from escaping from the packaging container. Consequently, no significant compression of air occurs in the interior space of the packaging container 3. Low compression would not be capable of forcing the cup out again. Furthermore, the clipping forces are adapted accordingly.

For the purpose of sealing the one component, the package is embodied in such a way that the jacket surface of the collar 9 of the sealing cap 4 has an annular sealing bead 8 which comes to rest against the corresponding inner surface of the cup 2. Several of such annular sealing beads 8 may be produced by molding.

The cup 2, which can be separated by means of the sealing cap 4, forms a rated or predetermined breaking point "S". The latter is formed by an annular step of the wall of the cup, such annular step being disposed inwardly in the cup and extending with a spacing "y" from the bottom 2' of the cup. This annular step receives the butt edge 9' of a collar 9 of the sealing cap 4, which butt edge is driven into the cup 2 from the top. The collar 9 is rooted in the bottom surface 10 of the sealing cap 4 and has the form of a cylindrical annular wall. The butt edge 9' extends perpendicular to the longitudinal center axis z—z of the two-component package, which is designed symmetrical with respect to rotation.

The pot bottom surface 10, which basically forms the ceiling of the polt-like sealing cap 4, has a slightly concave shape with a centrally disposed point.

Figure 5:
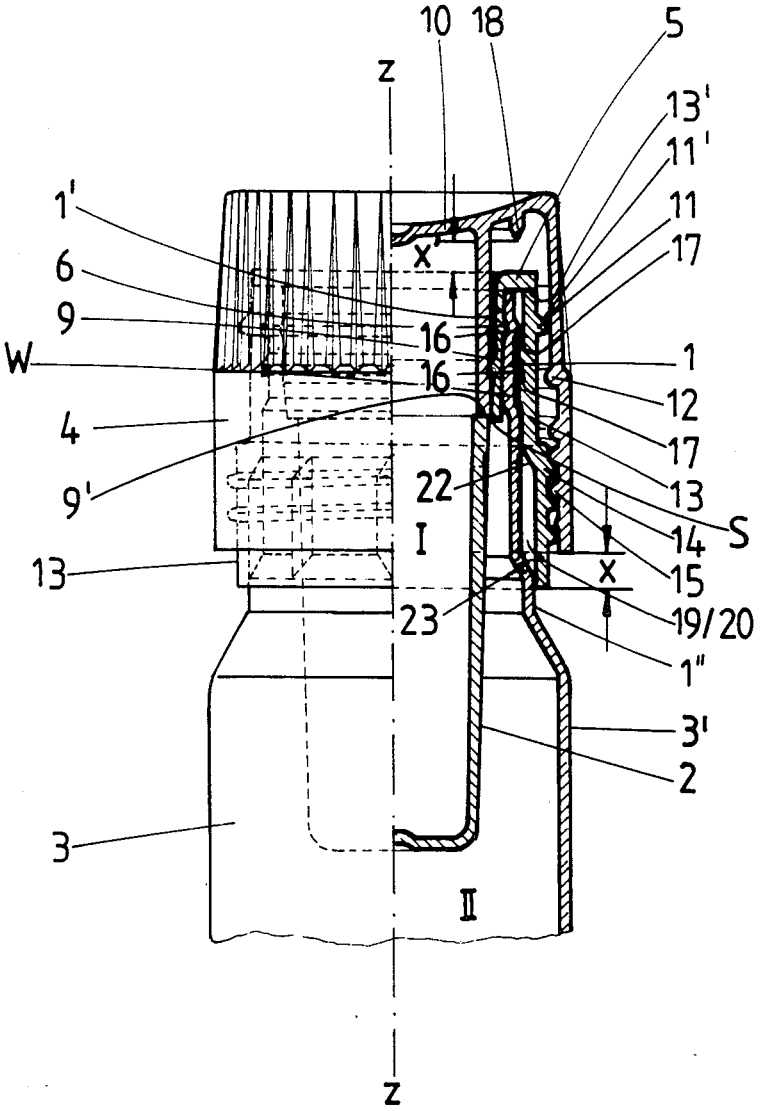
FIG. 5 shows the two-component package in its basic sales condition or before the cup is separated, in a partly sectional view as well.

In the basic sales condition, the butt edge 9' of the collar 9 is disposed with a spacing from the annular step in the wall of the cup forming the predetermined or rated breaking point "S". FIG. 5 practically shows the basic sales condition as the lower section of the cup has not yet been separated.

The basic sales position is defined by an annular rib 11 disposed above the butt edge 9, said rib 11 cooperating with an arresting rib 12 seated on the inner surface of the sealing cap 4. Both ribs extend horizontally. The top-side back of the annular rib 11 has a bevel 11' sloping downwardly in the direction of association with the sealing cap. The arresting rib 12 can smoothly run across this run-up bevel 11'. However, the bottom side of the annular rib 11 is relatively steep. When the sealing cap 4 is screwed on, the user will clearly feel resistance which, however, can be overcome easily. However, when the sealing cap 4 is unscrewed, the resistance is clearly stronger. By suitably aligning the top flank of the arresting rib 12 or by aligning this flank parallel with the steeper flank of the annular rib 11, even an irreversible association of the sealing cap 4 can be accomplished.

The annular rib 11 is produced by molding on the jacket surface of an adapter ring 13 which is slipped over the neck 1. This adapter ring 13 forms a relativelt thin-walled ring which, as a rule, supports the elastic neck 1 outwardly and whose outer surface supports the thread 14 for the sealing cap 4, the latter being provided on its inner wall surface with the matching female thread 15. The threaded zone is in the bottom half of the adapter ring 13, so that the top half can be peripherally used for the afore-explained arrest/overflow function.

Figure 6:
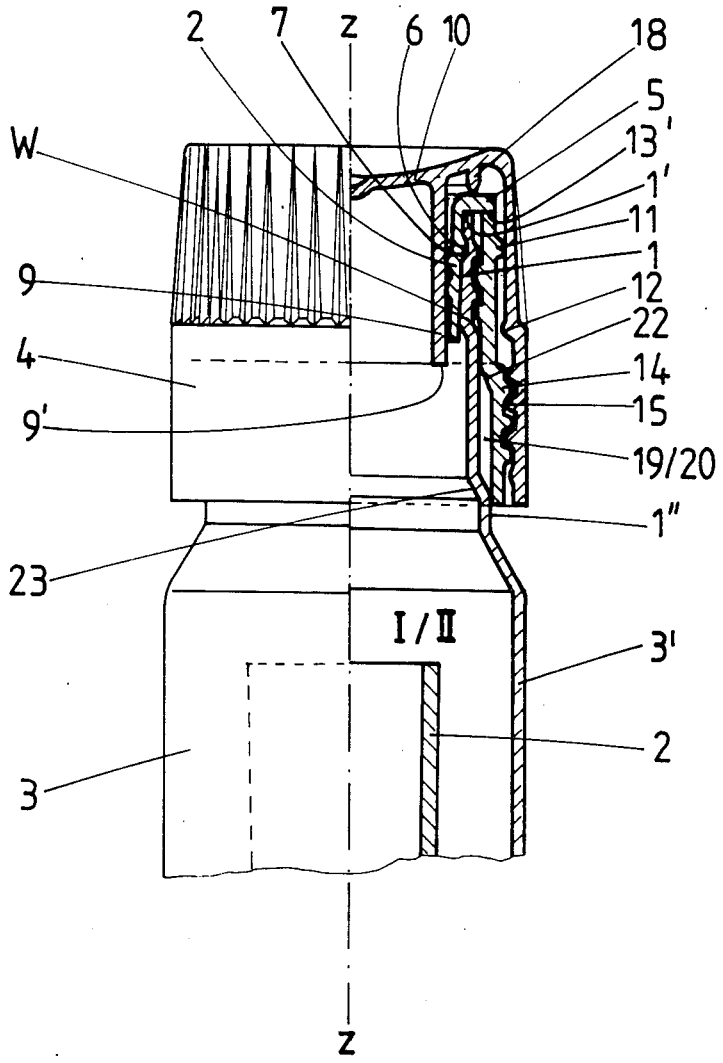
FIG. 6 is another partly sectional view of the two-component package, however, with the lower part of the cup cut off.

The shoulders 16 produced by molding on the outer side of the ring-shaped wall (W) of the neck 1 serve for securing the adapter ring 13 on the annular wall (W), which extends from the wall of the packaging container, and which is internally stiffened by the cup 2. These shoulders are ribs produced by molding on the lower flank that is aligned steeply relative to the longitudinal center axis z—z of the packaging container 3, with an axial spacing relative to the neck 1. The top flank has an acute angle for the purpose of forming a run-up bevel. The counter shoulder 17 undergripping the shoulder 16 consisting of pairs of molded annular ribs is located on the inner surface of the adapter ring 13 and forms in such location the top, steep flank of annular ribs, the latter also being produced by molding in pairs. The counter shoulder 17, too, forms run-up bevels on the bottom side of such annular ribs. FIG. 6 shows the engagement of the practically sawtooth-like structure. This association is irreversible and represents a form-locked engagement.

The top face edge 13' of the adapter ring 13 is disposed in the same plane as the face edge 1' of the neck 1, such edge 1' being overlapped or overgripped by the edge 5. The outwardly pointing annular face edge of edge 5 is disposed flush with the jacket surface of the adapter ring 13.

The following elements are included or incorporated in the multi-layered structure of the stabilized neck part of the packaging container 3 starting from the inside to the outside, such multi-layered structure being symmetrical with respect to rotation: The collar 9, which stiffens the cup 2 on the inside; the wall of the cup; the annular wall W of the neck 1; the adapter ring 13 stabilizing the latter; and finally the top wall of the sealing cap 4. The latter, consequently, forms the supporting end of the neck part both on the inside and outside, forming a downwardly open annular space.

An annular bridge 18, which is aligned concentrically with the collar 9, extends from the bottom of such annular space or, more precisely, from the pot bottom surface 10. Such annular bridge has a relatively low height and comes to rest on the horizontally extending top side of the edge 5 of the cup 2 when the sealing cap 4 is in its final screwed-down position (FIG. 6), in which the collar 9 has separated or cut off the detachable segment of the cup. For increasing the tightness in said location, the abutting free end of the annular bridge 18 is pointed in the form of a lip, which slightly penetrates the elastic material of the cup edge 5.

Figure 2:
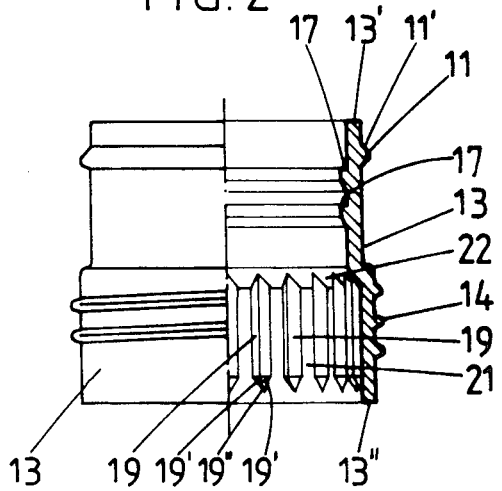
FIG. 2 is a partly sectional view of the adapter ring shown here in an isolated illustration.

Furthermore, the adapter ring 13 is secured against rotation on the annular wall W of the neck 1, such locking against rotation being produced by the claw coupling-like engagement of the fillets 19, 20, which are directed against one another. The fillets 19 are produced by molding on the inner surface of the adapter ring 13 on the bottom half of such ring; the fillets 20 are seated on the jacket surface of the neck 1. Both fillets have about the same length and a triangular cross section, with the one side of the triangle being rooted in the associated part. FIGS. 2 and 3 clearly show that the face ends of the fillets 19, such ends being directed against each other in the coupling direction, have the roof-like centering bevels 19' and 20', the latter being associated with the fillets 20. Such bevels change into a coping or ridge 19'' and 20'', respectively. Consequently, when the correspondingly shaped face ends move against each other with the fillets in equally directed positions, engagement is prevented due to rejection, so that the fillets can drive into the gaps 21 between the fillets. Furthermore, the ridge of both face ends acts as a stop means as it is joined with the bevel steps 22, 23 of the adapter ring 13 and neck 1. These bevel steps are produced by suitably displacing the wall of the two parts 13 and 1. The joint zone extends across half of the height of the adapter ring 13.

In addition, the fillets 19, 20 act as wall-stiffening elements, with an additional stiffening being produced in the lower, outwardly displaced section of the adapter ring 13 in the back of the fillets 19, i.e., on the outer side, by the molded thread 14, which basically extends crosswise relative to the fillets 19, forming a ring-like stiffening.

The way in which the bevel steps 22, 23 extend produces a certain widening effect acting on the lower half of the adapter ring, which produces an even firmer engagement between the thread 14 and the counter thread 15 of the sealing cap 4.

As the ridge line 19'' of the lower face end of the fillets 19 starts only with an axial spacing from the face edge 13'' of the adapter ring 13, one section of the inner surface of the ring is resting with additional support on the neck step 1'' of the annular wall W.

Furthermore, the adapter ring is used for forming an indicator means showing the condition of the contents, which clearly shows the user whether the two-component package is still in the original state or condition, i.e., the basic sales condition according to FIG. 5, or whether activation has already taken place. To form such indicator means, the end of the adapter ring 13 facing the container side freely projects in the basic sales condition (FIG. 5) by a measure "x" as compared to the corresponding edge of the sealing cap. This measure "x" conforms to the remaining displacement x' of the sealing cap, i.e., the displacement space through which the sealing cap still has to travel when rotated until it (sealing cap 4) is in its final screwed-down position (FIG. 6). The height of the sight ring so created may range from a few millimeters to one centimeter depending on the size of the package. A particularly conspicuous marking can be obtained by selecting a color for the material that is contrasting the color of the sealing cap 4. Also, partial coloring of the adapter ring 13 is conceivable in order to distinguish it from the exposed sight ring section.

FIG. 6 shows that in the final screwed-down position according to FIG. 6, the surface of such sight ring is covered by the sealing cap 4 when the latter has been screwed into the sealing position.

The separating function of the present two-component package has been explained in detail by the Applicant in German Pat. DE-PS No. 33 27 615.

All new features disclosed in the description and shown in the drawing are essential to the invention, including those not expressively claimed in the claims.

We claim:

1. Two-component package, with a cup arranged in the neck of the packaging container for receiving the one component, and a sealing cap screwed to a thread of the neck and having a collar projecting into the cup, the face edge of such collar forming a butt edge for separating the cup within the zone of a rated breaking point by a screw motion of the sealing cap, characterized in that the neck (1) is designed multi-layered in a way such that an adapter ring (13) is present on the outer side of the annular wall (W) of the neck (1), such wall starting from the wall (3') of the packaging container and being stiffened by the cup (2), such adapter ring being secured against rotation on such annular wall, the outer jacket surface of such adapter ring supporting the thread (14) for the sealing cap (4) and its inner surface forcing the annular wall (W) against the jacket surface of the cup.

2. Two-component package according to claim 1, characterized by a form-locking bead/groove joint (7/8) between the jacket surface of the cup and the annular wall (W).

3. Two-component package according to claim 1, characterized in that the annular wall (W) has on the outer side shoulders (16) clipped over by countershoulders (17) of the adapter ring (13).

4. Two-component package according to claim 1, characterized in that with an outwardly directed edge (5), the cup (2) grips over the top face edge (1' and 13', respectively) of the neck (1) and of the adapter ring (13).

5. Two-component package according to claim 1, characterized in that the sealing cap (4) has an annular bridge (18) starting from its pot bottom surface (10) for resting on and sealing the edge (5) of the cup (2) in the final screw thread position of the sealing cap (4).

6. Two-component package according to claim 1, characterized in that the jacket surface of the collar (9) of the sealing cap (4) has a sealing annular bead (8) contacting the corresponding inner surface of the cup (2).

7. Two-component package according to claim 1, characterized in that the lock against rotation is formed by axially aligned fillets (19, 20) on the annular wall (W) and the inner surface of the adapter (13), such fillets engaging each other in the manner of a claw coupling.

8. Two-component package according to claim 7, characterized in that the fillets (19, 20) are seated in a joint zone formed by wall displacement.

9. Two-component package according to claim 7, characterized in that the face ends of the fillets (19, 20) disposed in the coupling direction have roof-like centering bevels (19' and 20', respectively) whose copings (19'' and 20'', respectively), in the final plugged position, come to be disposed in front of equally directed bevel steps (22, 23) of the displacement joint zone.

10. Two-component package according to claim 1, characterized in that in the basic sales position, the end of the adapter ring (13) on the container side freely projects by a measure (x) as compared to the corresponding edge of the sealing cap, such measure conforming to the remaining lift (x') of the sealing cap (4) in the final screw thread position.

* * * * *